United States Patent [19]

Agabekov

[11] Patent Number: 4,521,838

[45] Date of Patent: Jun. 4, 1985

[54] TUBULAR ELECTRIC LAMP FIXTURE

[76] Inventor: Youri Agabekov, 54 bis quai Gustave, Ador, Geneva, Switzerland, 1207

[21] Appl. No.: 502,682

[22] Filed: Jun. 17, 1983

[51] Int. Cl.[3] ..... F21S 3/00

[52] U.S. Cl. ..... 362/219; 362/226; 362/249; 339/57

[58] Field of Search ..... 339/50 R, 52 R, 52 S, 339/57; 362/219, 249, 225, 226, 382; 248/248 (U.S. only), 262 (U.S. only), 263 (U.S. only)

[56] References Cited

U.S. PATENT DOCUMENTS

| | | | |
|---|---|---|---|
| 2,408,471 | 10/1946 | Merrill | 339/57 |
| 2,436,266 | 2/1948 | Richardson | 339/57 |
| 2,441,698 | 5/1948 | Gerspacher et al. | 339/23 |
| 2,463,961 | 3/1949 | Goehst | 339/57 |
| 2,960,761 | 11/1960 | Preader | 248/248 X |
| 3,643,085 | 2/1972 | Durand | 362/225 X |
| 4,158,221 | 6/1979 | Agabekov | 362/219 |

FOREIGN PATENT DOCUMENTS

| | | | |
|---|---|---|---|
| 603703 | 10/1934 | Fed. Rep. of Germany | 339/52 R |
| 2123853 | 11/1971 | France . | |

OTHER PUBLICATIONS

*Lighting,* Feb. 1955, p. 39, (Advertisement for Crownlite).

*Primary Examiner*—Stephen C. Bentley
*Assistant Examiner*—John S. Maples
*Attorney, Agent, or Firm*—Gunn, Lee & Jackson

[57] ABSTRACT

A fixture for a plurality of tubular electric lamps comprises an elongated insulating angle bar-frame having two flat mutually perpendicular flanges joined by a flat central web at 45° angle to the flanges. Flat metal conductor bars carried on the back side of the flanges have integrally upstanding lamp carrying tabs spaced along the entire length of the conductors protrudes through slots in the frame. Lamp carrying tabs are thus alternately disposed along the entire length of the frame which support the lamps in axial alignment. The flat conductors are secured to the back side of the flanges by means of self-adhesive bands. Improved structural strength is achieved by the frames having integral ribs or struts connecting the perpendicular flanges and the flat central web.

3 Claims, 7 Drawing Figures

TUBULAR ELECTRIC LAMP FIXTURE

BACKGROUND OF THE INVENTION

The invention relates to an improvement to fixtures for a plurality of elongated tubular electric lamps having contact caps at both ends. The improvement incorporates specially fabricated support members and conductor strips which simplify assembly while increasing the electrical safety aspects of the device. For convenience the elongated tubular electric lamps will hereinafter be referred to as tubular lamps, or simply as lamps.

DESCRIPTION OF THE PRIOR ART

The closest prior art known to the inventor is his U.S. Pat. No. 4,158,221. Light fixtures of the type involved herein have in the past been known and in the broad sense consist of a long support carrying a series of lamps for illuminating display windows, bookshelves, the inside of large pieces of furniture, handrailings, etc.

Until the inventor developed the fixture disclosed and claimed in U.S. Pat. No. 4,158,221, the known fixtures usually consisted of a flat insulating support carrying two spaced-apart flat conductor bars disposed side-by-side. One such device is the so-called Mini-Rampe construction of a French company named "Wendel." Such construction is disclosed in French Pat. No. 2,123,853. The conductor bars in French Pat. No. 2,123,853 have projecting tab portions along their outer edge which must be bent or folded in two 90° folding operations in order to receive and carry the ends of tubular lamps placed along a common axis parallel to the support. The manufacture of the conductor bars with the edge projecting lamp carrying parts is relatively complicated and costly, and the folding operation has to be precisely done or the lamp carrying parts will not properly align.

In the manufacture of the conductor bars, the cutting of the edge projecting conductor bars involves a considerable waste of material, the part situated between two projections being lost; this is all the more important as the spacing between adjacent lamps increases. Further, the two folding operations involve either complicated machinery or at least somewhat skilled or coordinated laborers; certain handicapped individuals simply can not be used in the assembly process. A first folding operation to bring the projecting part perpendicular to the conductor bar has to be accomplished. Next, a second folding operation is necessary to bring the lamp-supporting projecting part perpendicular to the axis along which the lamps were mounted. Finally, the conductor bars have to be secured on the support after verification that the distance between each lamp holder corresponds to the length of the lamp.

U.S. Pat. No. 4,158,221 overcame many of these problems by providing a fixture comprising two metal conducting bars mounted on an elongated support with lamp-holding conducting brackets projecting from the bars. The support is an angle member having two flat flanges disposed perpendicular to one another and extending parallel to an axis of the angle member. The metal bars are carried by the inner surfaces of the two flanges. The lamp-holding conducting brackets are L-shaped and fixed alternately in pairs with selected spacing along one metal conductor bar and the other. The brackets have upstanding parts protruding from and disposed transverse to the respective bars and the upstanding parts of all the brackets have aligned portions which include means for holding lamps parallel to the axis of the angle support.

The L-shaped brackets are attached to the metal bars and not integral to the bars. The brackets are mounted on the flanges such that they are stopped from rotating by the inclined wall separating the two flanges.

This invention (U.S. Pat. No. 4,158,221) eliminated the waste and folding problems associated with the prior art edge projecting conductor by simply requiring the brackets to be mounted on flat, continuous metal bars. However, the assembly process, while simplified in some respects, was complicated by having additional parts.

U.S. Pat. No. 2,441,698 to Gerspacher et al. provides and discloses an electrical molding in which standard solid wire, either bare or insulated, may be used as the conductor. The conductors are substantially completely enclosed and are inserted into the molding in a pair of spaced longitudinally extending tubular apertures. The wires are sufficiently smaller in diameter than the apertures to permit the wire to be readily inserted during assembly of the unit and to be moved lengthwise if it is desired to shorten one of the molding units. Connector clips are secured to the conductors by means of resilient conductor engaging sleeve portions which engage the conductor. These sleeves have a smaller end made of a slightly smaller diameter than the conductor wires so that an electrical contact will be made between the clips and the wires while still permitting relatively sliding movement of the wires in the sleeve portions of the clips. The obvious difficulty in this type of structural arrangement is ensuring that a good electrical contact can be made. As heat builds up at the contact point, the sleeves tend to loosen and electrical contact is lost or at least a dangerous hot spot develops.

SUMMARY OF THE INVENTION

The present elongated tubular electric lamp fixture invention utilizes a specially constructed support frame which incorporates specially constructed conductor strips carried along the back side of the frame. The frame is an elongated angle member having two flat flanges perpendicular to one another and connected by a flat central web of substantially the same width as the flanges and inclined at 45° to them. The frame also has lamp carrying tab slots spaced along and formed into the two flat flanges. Ribbing or strut members are spaced along and integral to the inside surface of the support frame providing additional strength to the frame structure.

Flat metal conductor strips, having upstanding lamp carrying tabs spaced along their entire length and protruding from and punched out from the center of the strips, are carried in longitudinal grooves formed in the back side of the flat flanges of support frames. The upstanding tabs protrude through the spaced lamp carrying tab slots.

The tabs are positioned and paired on the inside of the frame so as to cooperate and support tubular electric lamps. Further, the metal bars are continuous strips which overlap frame section joints, holding the sections together. Structural strength of the fixture is improved without having to weaken ribs or struts by slotting or boring them to facilitate the carrying of the metal conductor bars on the inside surface. Assembly is simplified and costs and waste are reduced.

Self-adhesive strips are affixed to the back side of the frame securing the metal strips to the frame and acting as an insulator.

DETAILED DESCRIPTION OF THE PREFERRED EMBODIMENT

Figure 1:
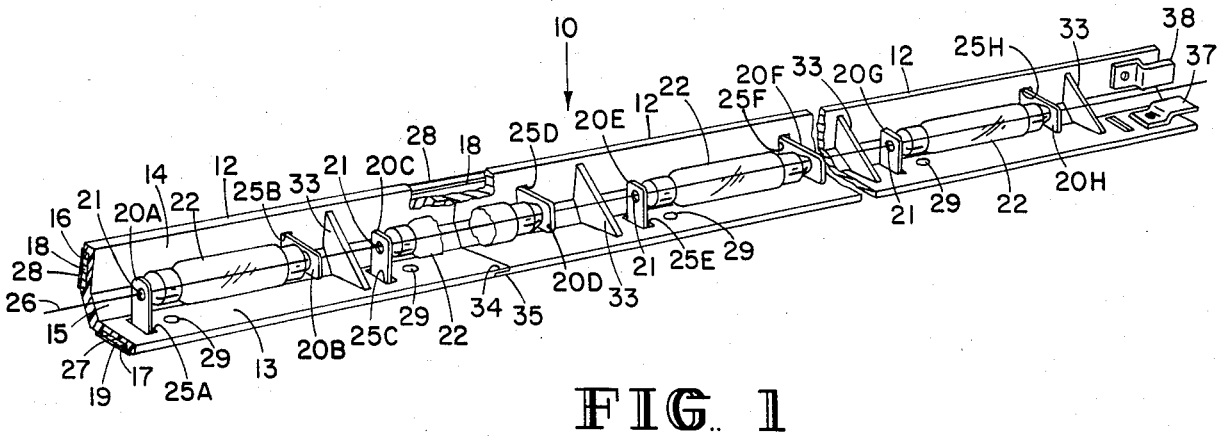
FIG. 1 is a perspective view of the invention with a cutaway and exposed portions showing conductor bar and self-adhesive tape at a joint.
Figure 2A:
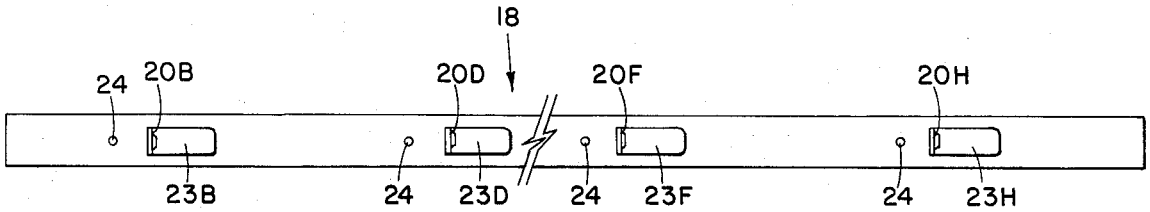
FIG. 2A is a top view of the conductor bar of the invention.

The fixture 10 shown in FIG. 1 comprises a support 12 of insulating material, for example, synthetic plastic material, in the form of an elongated angle member having two flat flanges 13 and 14 perpendicular to one another and connected by a flat central web 15 of substantially the same width as the flanges 13 and 14 and inclined at 45° to them. The central web 15 has elongated grooves 16 and 17 extending the entire length of the back side of flanges 14 and 13 respectively. Grooves 16 and 17 are adapted to receive flat metal conducting bars 18 and 19. Along the bars 18 and 19, and punched out from the center thereof, are pairs of spaced lamp carrying tabs 20A, 20B; 20C, 20D; 20E, 20F; 20G, 20H; and so on, each tab being an integral part and upstanding from bars 18 and 19 (see FIGS. 2A and 2B). Each upstanding tab 20A, 20B, 20C, etc. has an opening 21 defining a socket for receiving and holding one of the end-caps of a tubular lamp 22. As previously stated, the upstanding lamp carrying tabs 20A, 20B, 20C, etc. is punched out or stamped from the center of bars 18 and 19, leaving a small aperture 23B, 23D, 23F, . . . as can be seen in FIG. 2A, without there being any waste of material in the construction of the upstanding tabs 20A, 20B, 20C . . . . Bars 18 and 19 are further adapted with rivet bore holes 24 which are used when rivets are additionally utilized to secure bars 18 and 19 to the respective flanges 13 and 14 of support 12. The upstanding lamp carrying tabs 20A, 20B, . . . project from the center of bars 18 and 19 and protrude through lamp carrying tab slots 25A, 25B, 25C, 25D, . . . in an alternating fashion to form pairs, each pair being able to receive and hold a tubular lamp 22 (as shown for pairs 20A and 20B; 20C and 20D; 20E and 20F). The length of the upstanding tabs of the bars is such that they have aligned portions whereby the openings 21 are all aligned along an axis 26 parallel to the axis of support 12. Bars 18 and 19 are secured to flanges 13 and 14, respectively, by self-adhesive bands 27 and 28, having removable protective papers (not shown). Additionally, bars 18 and 19 may be secured to flanges 13 and 14 by means of rivets 29 which pass through apertures 30 and flanges 13 and 14.

Figure 2B:
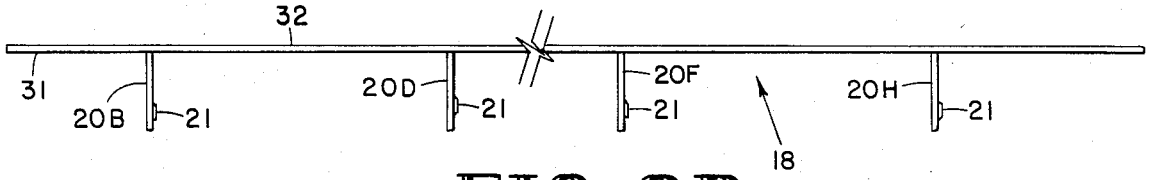
FIG. 2B is an elevation view of the conductor bar of the invention.

FIGS. 2A and 2B show the details of one of the specially constructed flat metal conductor bars 18. As can be seen in FIGS. 2A and 2B, lamp carrying tabs 20B, 20D, 20F, 20H, . . . can be simply punched out or stamped from metal bar 18 without any excessive waste of material. The punching process also forms opening 21 defining a socket for receiving and holding one of the end caps of the tubular lamp. The stamping process further results in the formation of apertures 23B, 23D, 23F, 23H being formed in the center of metal bar 18. FIG. 2B illustrates the upstanding perpendicular relationship of lamp carrying tabs 20B, 20D, 20F, 20H in relation to the inside surface 31 and the outside surface 32 of bar 18.

Figure 3:
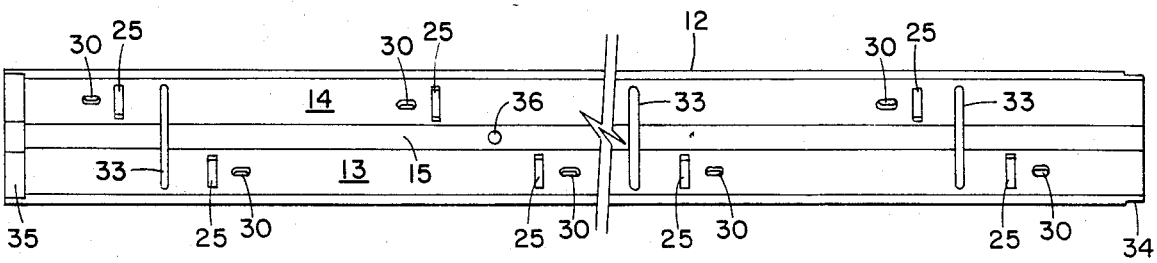
FIG. 3 is a front view of the support frame of the invention without the conductor bars.

FIG. 3 is a detailed drawing showing the specially molded support frame 12 wherein flat flanges 13 and 14 have adapted therein lamp carrying tab slots 25 and rivet apertures 30. Spaced along the inside surface of frame support 12 and integral to support 12 are molded ribs or struts 33 integral to the perpendicular flat flanges 13 and 14 and flat central web 15.

FIG. 3 also shows a male end 34 and a female end 35 on this section of support 12. A plurality of frame support sections 12 may be joined together by inserting the male end portion 34 of one frame support section with the female end portion 35 of another frame support section. Looking again at FIG. 1, the connection of two frame support sections can be seen with male end portion 34 inserted in female portion 35. FIG. 1 also shows a cutaway and exposed portion of frame 12 showing how metal bar 18 overlaps over the junction of the male end 34 and the female end 35, forming a continuous joint between the two separate frame support sections.

Figure 4:
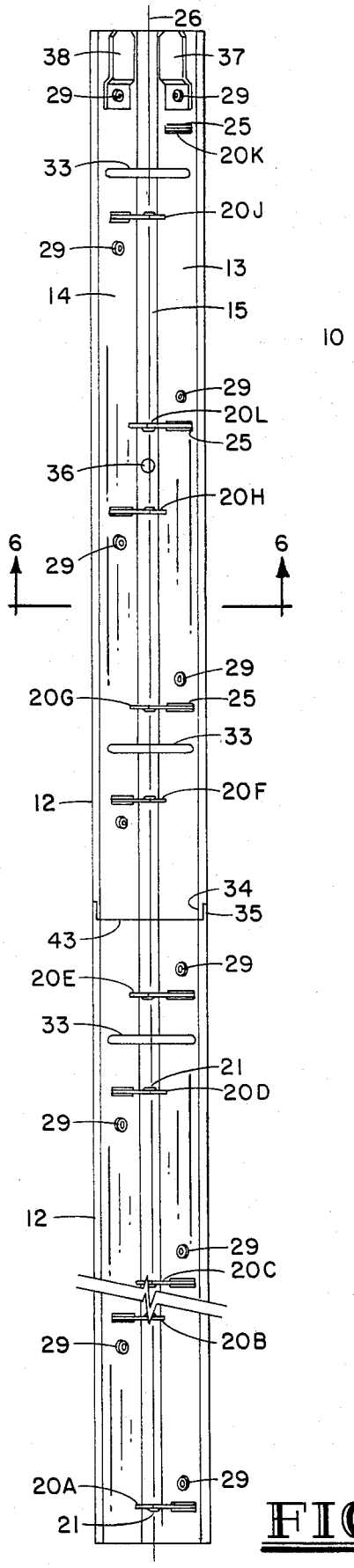
FIG. 4 is a front view of the invention without tubular electric lamps.

FIG. 4 illustrates how the lamp fixture appears without tubular lamps. As can be seen in FIG. 4, each of the openings 21 are all aligned along an axis 26 parallel to the axis of support 12. While only one mounting bore 36 is shown in FIG. 4, any number of such bores may be drilled or formed into support 12 as required for the particular installation. Again, ribs or struts 33 providing additional support to frame 12 are shown. At lamp carrying tab slot 25, in FIG. 4, is illustrated the situation where the fixture 10 does not require the lamp carrying tab 20 to project upwardly and protrude through tab slot 25. The situation exists where no lamp is placed in the fixture. During assembly, the lamp carrying tab 20K is either clipped and salvaged or is merely pressed flat and even with the surface of the flat metal conducting bar so as not to protrude through the slot 25 and so as not to cause an irregularity on the back side of flange 12. Also shown in FIG. 4 are conductors 37 and 38 which connect bars 18 and 19 to a power source (not shown) by means of rivet 29 passing through rivet aperture 30 and rivet bore hole 24.

Figure 5:
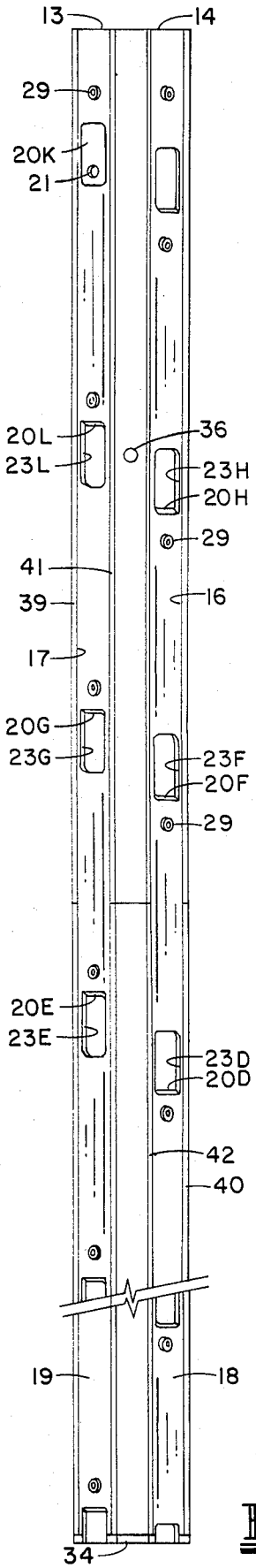
FIG. 5 is a back view of the invention of FIG. 4.

FIG. 5 is a back view of the invention shown in FIG. 4. FIG. 5 shows how bars 18 and 19 set into grooves 16 and 17. Groove shoulders 39, 40, 41, 42 are exposed for affixing self-adhesive bands which in turn cover the entire back side of flanges 13 and 14 securing bars 18 and 19 to support 12. As can be further seen in FIG. 5, bars 18 and 19 are continuous as they pass over joint 43, formed by two support sections, thus holding joint 43 in closed relationship when lamp carrying tabs 20A, 20B, 20C, . . . are projecting through and protruding from tab carrying slots 25A, 25B, 25C, . . . in support 12.

Figure 6:
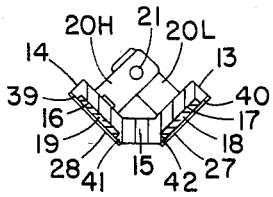
FIG. 6 is a cross-sectional view of the invention of FIG. 4.

FIG. 6 illustrates the alignment of openings 21 in tabs 20H and 20L, while also showing how bars 18 and 19 are secured to the back side of flanges 13 and 14 in grooves 16 and 17 with self-adhesive bands 27 and 28 affixed to the back of bars 18 and 19 and shoulders 39, 40, 41, 42.

The assembly can be assembled without difficulty, the metal bars 18 and 19 simply being pressed between shoulders 40 and 42, 39 and 41, in grooves 16 and 17 on the back side of flanges 14 and 13, respectively. Lamp carrying tabs 20A, 20B, 20C, . . . simply slide through tab slots 25A, 25B, 25C, . . . for ready acceptance of lamps 22. Protective papers are removed from one side of self-adhesive strips 27 and 28 and are applied to the back side of flanges 13 and 14 securing metal bars 18 and 19 in grooves 16 and 17.

In situations where the user desires to eliminate lamps 22 along fixture 10, he simply presses down the appropriate lamp securing tab 20 so that such tab does not protrude through tab slot 25, thereby eliminating a lamp from that particular location. If, at a later date, it is determined that more lighting is required, the user simply removes the fixture from its location, presses lamp carrying tab 20 into the upstanding position perpendicular to the strip and projects the tab through slot tab 25, thus providing an additional location for placement of a lamp. (As can be seen from this disclosure, it would be necessary to ensure that a pairing of tabs is provided in order to install a lamp at any particular location.)

The foregoing is considered illustrative only of the principles of the invention. Further, since numerous modifications and changes will readily occur to those skilled in the art, it is not desired to limit the invention to the exact construction and operation shown and described, and accordingly any suitable modifications and equivalents may be resorted to, falling within the scope of the invention as claimed.

I claim:

1. A fixture for a plurality of tubular electric lamps, said fixture comprising:

an elongated frame of generally L-shaped cross-section formed of insulating material and comprising a pair of longitudinally extending flanges substantially at right angles to each other, each of said flanges having a front side and a back side, each of said back sides having a groove extending longitudinally the entire length of each of said back sides;

a first and second electrically conductive flat metal bar each having a plurality of integral foldable lamp carrying tabs perpendicularly upstandable from the center of said bars, said tabs having been stamped from the center of said bars, said tabs spaced along the entire length of said metal bars, one such bar extending longitudinally in and lying flat against said groove in said back side of each said flange of said frame such that when tabs are folded upstanding and perpendicular such tabs project through spaced slots along said flange;

said tabs further longitudinally spaced along said fixture such that said tabs in first said bar cooperate with said tabs in said second bar so as to be capable of supporting at least one of said lamps in a position substantially parallel to, overlying, and spaced from said front side of said flanges with an axis lying substantially on the line of juncture of two projected longitudinal planes, one of which planes also includes the longitudinal center line of one of said bars and the other of which planes also includes the longitudinal center line of the other said bar;

a pair of self-adhesive bands, one such band extending longitudinally along the back side of each of said flanges and overlapping said flat metal bars for electrical insulation thereby securing one of said flat metal bars in each of said grooves of each of said back side of said flanges.

2. A fixture as defined in claim 1 wherein said frame is further:

adapted with integral structural ribs on the inside surface of said frame, joining and strengthening said flat flanges and including a spacing wall lying between and serving to connect the flanges of the frame and having portions lying at an angle to each of said flanges of said frame.

3. A fixture as defined in claim 1 wherein said metal bars overlap the connecting joint between two sections of said frame serving to keep abutting ends of said sections closely joined.

* * * * *